United States Patent [19]

Hamilton

[11] 4,386,385

[45] May 31, 1983

[54] SPARK ELECTRODE ASSEMBLY

[75] Inventor: Martin W. Hamilton, Arlington Heights, Ill.

[73] Assignee: Eaton Corporation, Cleveland, Ohio

[21] Appl. No.: 175,981

[22] Filed: Aug. 7, 1980

[51] Int. Cl.[3] ..... F24C 3/10

[52] U.S. Cl. ..... 361/253; 313/141; 431/263

[58] Field of Search ..... 361/253, 263; 431/263, 431/264, 265, 266; 313/141, 332

[56] References Cited

U.S. PATENT DOCUMENTS 3,511,588 5/1970 Wolfe et al. ..... 431/264

3,926,172 12/1975 Saponara ..... 431/264

*Primary Examiner*—C. C. Shaw

*Attorney, Agent, or Firm*—C. H. Grace; R. A. Johnston

[57] ABSTRACT

A spark electrode assembly (10) for a gas range igniter system is disclosed which is low in cost, easy to assemble, and reliable in operation. The assembly comprises a resilient, electrically conductive support member 18 having a U-shaped configuration and adapted for connection to the top frame of the gas range. An integrally molded insulator member (46) is connected to the support by means of a peripheral flange portion (50) which extends through rectangular openings (38) formed in parallel leg portions (43, 44) of the support. The inward spring bias exerted by the legs of the support maintain the insulator assembled thereto. A barbed, wire connecting insert (60) is crimped to an electrical lead (58) and inserted into a bore (54) in the insulator. Barbs (64, 66) on the insert abut against the top surface of a wall (56) which extend inward radially from the internal wall of bore (54) and prevent removal of the electrical lead from the insulator.

15 Claims, 4 Drawing Figures

SPARK ELECTRODE ASSEMBLY

BACKGROUND OF THE INVENTION

The invention relates to ignition devices for gaseous fuel burners and is particularly directed to an electrical spark igniter for use in household gas ranges.

DESCRIPTION OF THE PRIOR ART

Electrical spark igniters for use in household applicanes are known in the art and function to replace continuously burning gas pilots in order to conserve gas usage.

One such known igniter comprises a tubular insulator having a central bore extending therethrough in which is received and secured an electrical lead. The upper end of the lead is aligned with the top end of the insulator and functions as an electrode. A C-shaped bracket formed of a conducting material includes a horizontal portion aligned over the electrode end of the lead and spaced therefrom by a gap of predetermined distance. A downwardly projecting dimple is formed in the bracket in vertical alignment with the electrode end of the wire and defines a ground potential electrode.

In aforesaid known device, the electrical lead is secured to the insulator by a screw which is threaded into the lead end thereof.

Another known spark igniter comprises a structure similar to that described above but which utilizes a tapered, barbed clip inserted into the electrode end of the insulator for securing the electrical lead thereto.

SUMMARY OF THE INVENTION

In the present invention an electrical spark igniter for a gas fuel burner is provided having a simplified, low-cost construction. The igniter comprises a preferably U-shaped, ground support formed of a resilient material such as spring steel. Horizontal mounting leg portions extend outwardly from the ground support for connection to a suitable location on a range top near a gas burner.

An insulator formed of a ceramic or plastic material has an outer flange portion adjacent its upper end. Sections of the flanged portion extend into vertically aligned rectangular openings provided in parallel legs of the U-shaped ground support, thus establishing the assembled position of the insulator. An inwardly directed spring bias exerted by parallel sections of the U-shaped support allows the insulator to be easily and quickly assembled to the support by pressing the insulator between the legs of the support until the flanged sections snap into the rectangular openings.

A centrally located, raised dimple is formed into the inside wall of the support and is axially aligned with the insulator and defines a first electrode.

An electrical lead is connected to a barbed retaining clip which extends into a central bore in the insulator. The downwardly opening barbs abut against the upper surface of a shoulder formed by an internal flange projecting from the internal wall of the insulator central opening. The outer tip of the clip defines a second electrode and is spaced a predetermined distance from the first electrode.

It is thus an object of the invention to provide a spark electrode assembly which is low in cost and easy to assemble.

It is another object of the invention to provide an electrical spark ignition system having the above mentioned features and objects.

DETAILED DESCRIPTION

Figure 1:
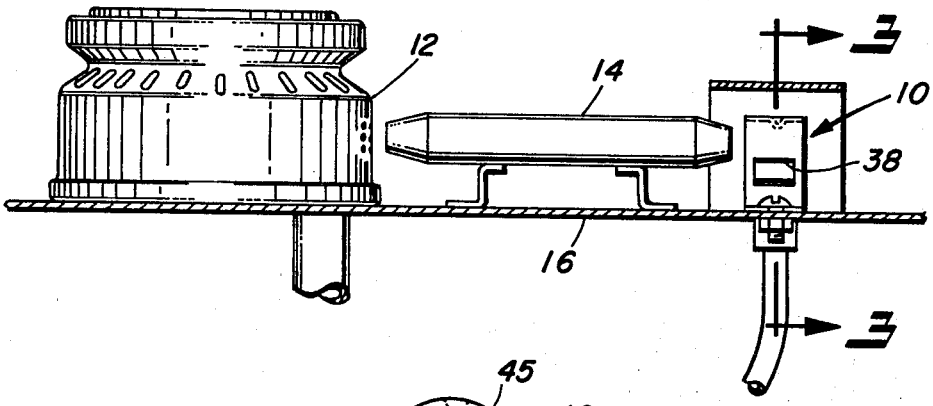
FIG. 1 is a view in elevation of an electrical spark igniter according to the invention and shown in association with gas range top components.
Figure 2:
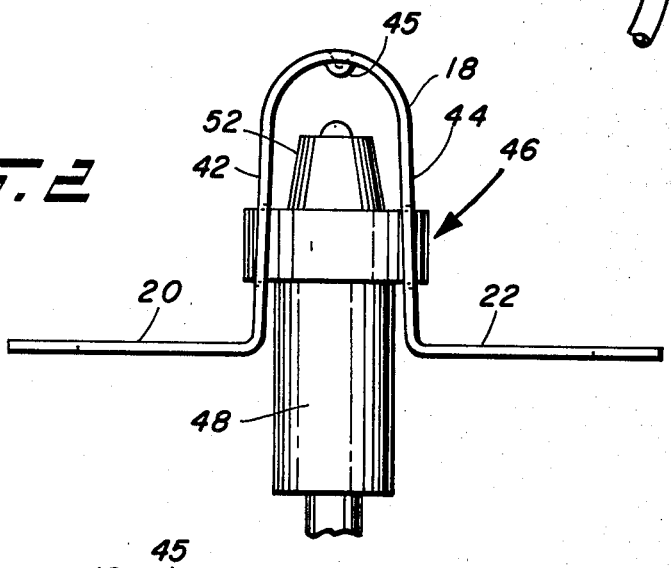
FIG. 2 is a left side view of the igniter taken from FIG. 1.
Figure 3:
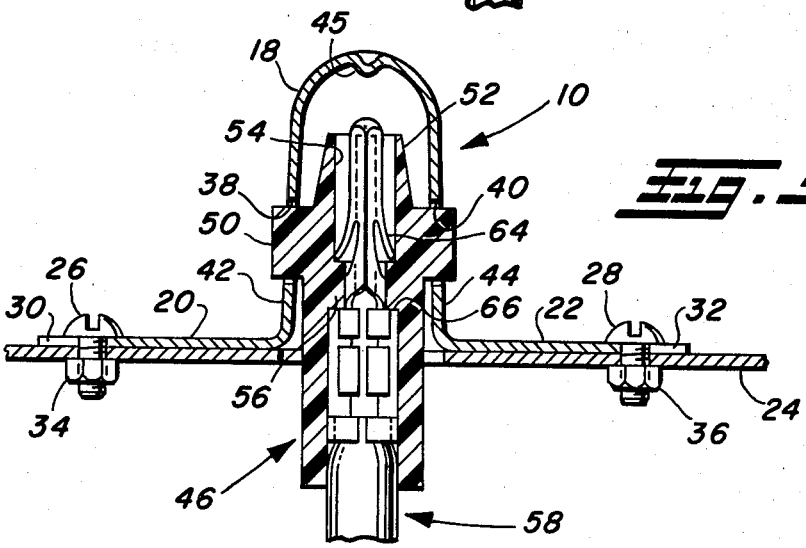
FIG. 3 is a cross sectional view taken along section lines 3—3 of FIG. 1.

Referring now to FIGS. 1-3, there is indicated generally by reference numeral 10 an electrical spark igniter assembly embodying the principles of the invention and shown in association with gas range burner components and range top structure such as a gas burner 12, and a flash tube 14 which functions to transfer flame to burner 12 in a manner well known in the art. Igniter 10 is shown as connected to range top structure 16.

Igniter assembly 10 includes a preferably U-shaped support member 18 having horizontally extending support legs 20, 22 which function to mount the igniter to frame 16. Support 18 is also hereinafter designated as a shroud. In the presently preferred practice support member 18 is dapted for electrical connection to ground potential. The igniter is secured to frame 16 by screws 26, 28 which extend through slots 30, 32 formed in legs 20, 22 respectively. Threaded nuts 34, 36 are received over the ends of screws 26, 28 respectively.

Rectangular openings 38, 40 are formed in parallel vertical portions 42, 44 of support 18. A downwardly extending dimple 45 is formed on the top inside surface of the U-shaped portion and functions as a spark receiving electrode as will be described further. In the preferred form of the invention, the support 18 is fabricated of a suitable electrically conductive spring material as, for example, tempered stainless steel.

An elongated insulator, indicated generally at 46, includes a cylindrical body portion 48 having an outer diameter sized for a clearance fit between the inside spacing of vertical portions 42, 44.

An outer flange portion 50 is formed around the upper end of cylindrical portion 48. The thickness of flange 50 is sized to fit in closely spaced relationship to openings 38, 40. An inward spring bias exerted by support 18 functions to maintain the inside surfaces of vertical portions 42, 44 squeezed against insulator 46, thereby connecting the insulator to the support prior to attachment to range top frame 16.

The upper end of insulator 18 above flange 50 terminates in a conical surface portion 52. A centrally located bore 54, also designated as a hollow, extends through insulator 18. A radial wall portion 56 projects inward radially from the surface of bore 54 and is positioned intermediate the ends of the insulator. In the preferred form of the invention, insulator 46 is injection molded from a thermoplastic material having a suitable dielectric strength. A polysulfone material has been found particularly acceptable. It should be noted that the insulator could be molded from a suitable ceramic material without departing from the scope of the invention.

An electrical lead, indicated generally at 58, is crimped to a barbed, wire connecting insert, indicated generally at 60. Insert 60 is fabricated of a preferably nickel plated, electrically conductive material. Insert 60 is a commercially available item known as a "poke-home" connector and includes a closed ended upper shell portion 62. A pair of barbs 64, 66 flair outwardly from the lower end of shell portion 62. The upper end of lead 58 has the insulation removed and extends into shell portion 62. Tabs 68 are crimped over the lead, thereby connecting the lead to the insert.

Abutment tabs 70 extend radially outwardly from the insert and are in abutment with the lower surface of radial wall 56.

In assembly, lead 58 with insert 60 connected thereto is forced into bore 54 until barbs 64, 66 snap over the top surface of wall 56. Tabs 70 prevent further insertion into the insulator and function to establish the end position of the exposed tip of the insert relative to the top surface of the insulator.

The spark igniter assembly is completed by inserting insulator 46 into support 18 and urging it toward dimple 45 until rectangular openings 38, 40 snap over flange 50.

In operation, an electrical potential is applied to lead 58 which results in a discharge flow of current, or spark, traveling across the gap. In the present practice of the invention, for a gap of about 2.29 mm, a voltage potential in the range of about 7000 to 20,000 volts will result in creation of a suitable spark for gas ignition.

Figure 4:
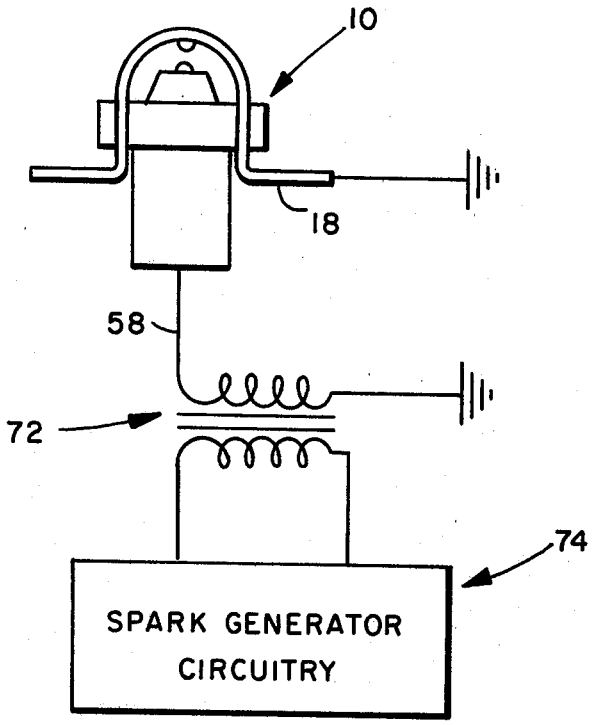
FIG. 4 is an electrical diagram of a spark igniter circuit employing the present invention.

Referring now to FIG. 4, there is shown schematically an electrical spark igniter system embodying the principles of the invention and comprising the electrical spark electrode assembly 10 of FIGS. 1–3, a high voltage transformer, indicated generally by reference numeral 72, and spark generator circuitry indicated schematically by reference numerals 74. Electrical details of spark generator circuitry 74, which includes an appropriate operator control switch, are widely known in the art and readily available from numerous commercial sources. Support 18 is shown as connected to ground and lead 58 is connected to one coil of transformer 74, which is also connected to ground.

The embodiment of the invention as shown and described above is representative of the inventive principles as stated herein. It is to be understood that variations and departures can be made from the here described embodiment without, however, departing from the scope of the appended claims.

What is claimed is:

1. A spark-type igniter assembly for igniting a combustible air fuel mixture comprising:

(a) shroud means including a member with first integral surface portions thereof forming one electrode and with second integral surface portions thereof spaced from said first portions, said second portions defining locking means adapted for locking engagement with an insulator, said member having third portions integral therewith adapted for connection to a support, whereupon said shroud and said one electrode are electrically grounded;

(b) insulator means received in said shroud means, said insulator means including a member having a hollow therein and having surface mounting portions formed thereon external with respect to said hollow, with said mounting portions engaging said shroud second surface portions locking means in snap-locking engagement for retaining said insulator in said shroud means; and (c) electrical lead means received in said hollow including a clip member having one end portion thereof including means defining a second electrode with other portions of said clip member engaging the inner periphery of said hollow in snap-locking engagement, said lead means including an electrical conductor having one end connected to said clip member and said second electrode and the other end extending from said insulator hollow for attachment thereto, wherein said first and second electrodes are spaced such that upon application of a predetermined electrical potential to said lead a spark is discharged between said first and second electrodes for ignition of said mixture.

2. The assembly as defined in claim 1, wherein said shroud means first surface portions include a downwardly extending dimple aligned with said second electrode means.

3. The assembly as defined in claim 1, wherein (a) said insulator means member includes a radial wall portion extending inwardly from the surface of said hollow and disposed intermediate the ends thereof; and (b) said clip member is a thin walled insert adapted for receiving said electrical conductor, said clip member including barbed portions which abut with the upper surface of said radial wall thereby preventing pull-out of said electrical conductor from said insulator means member.

4. A spark electrode assembly, said assembly comprising:

(a) a generally U-shaped support member formed of an electrically conductive material and adapted for electrical connection to ground potential, said support member including surface portions formed integrally therewith which, upon connection of said support member to said ground potential, form one electrode for receiving a spark-discharge current flow;

(b) insulator means including a hollow member having peripheral surface portions engageable with said support member in quick-locking engagement for connecting said insulator means to said support member; and (c) electrical conductor means received in said hollow, said conductor means including (i) means defining a second electrode spaced a predetermined distance from said one electrode, (ii) means for retaining said lead in said insulator hollow, wherein, upon application of a sufficient electrical potential to said conductor means, a spark is discharged between said first and second electrode for ignition purposes.

5. The device as defined in claim 4, wherein said support surface portions include a downwardly extending dimple aligned with said second electrode means.

6. The device as defined in claim 4, wherein (a) said insulator means includes a radial wall portion extending inwardly from the surface of said central bore and disposed intermediate the ends thereof; and (b) said retaining means includes a thin walled insert adapted for receiving an electrical conductor, said insert including barbed portions which abut with the upper surface of said radial wall thereby preventing pull-out of said conductor means from said insulator.

7. The device as defined in claim 4, wherein said U-shaped support is flexible outwardly for permitting insertion of said insulator flanged portion into locking engagement with said openings.

8. An electrical spark ignition system for igniting a combustible air-fuel mixture, comprising:

(a) shroud means including a member with first integral surface portions thereof forming one electrode and with second integral surface portions thereof spaced from said first portions said second surface portions defining locking means adapted for locking insulator attachment thereto, said member having third integral portions adapted for connection to a support, whereupon said shroud and said one electrode are electrically grounded;

(b) insulator means received in said shroud means, said insulator means including a member having a hollow therein and having surface mounting portions formed thereon external with respect to said hollow, with said mounting portions engaging said shroud second surface portions locking means in snap-locking engagement for retaining said insulator in said shroud means;

(c) electrical lead means received in said hollow including a clip member having one end portion thereof including means integral therewith defining a second electrode with other portions of said clip member engaging the inner periphery of said hollow in snap-locking engagement, said lead means including an electrical conductor having one end connected to said clip member and said second electrode and the other end extending from said insulator hollow for attachment thereto, said first and second electrodes being spaced a predetermined distance; and (d) circuit means connected to said electrical lead means and connectable to a sufficient electrical potential such that upon application thereof a spark is discharged between said first and second electrodes for ignition of said mixture.

9. An electrical spark ignition system, said system comprising:

(a) a generally U-shaped support formed of an electrically conductive material and adapted for electrical connection to ground potential, said support including surface portions integral therewith which, upon connection of said support to said ground potential, form one electrode for receiving a spark-discharge current flow;

(b) insulator means including a hollow member having peripheral surface portions engageable with said support member in quick-locking engagement for connecting said insulator means to said support member;

(c) electrical conductor means received in said hollow, said conductor means including (i) means defining a second electrode spaced a predetermined distance from said one electrode, (ii) means for retaining said conductor means in said insulator hollow, and, (d) circuit means connected to said conductor means and connectable to a sufficient electrical potential such that upon application thereof a spark is discharged between said first and second electrodes for ignition purposes.

10. The system as defined in claim 9, wherein said support surface portions include a dimple extending therefrom aligned with said second electrode means.

11. The system as defined in claim 9, wherein (a) said insulator means includes a radial wall portion extending inwardly from the surface of said central bore and disposed intermediate the ends thereof; and (b) said retaining means includes a thin walled insert adapted for receiving an electrical conductor, said insert including barbed portions which contact said radial wall portion in a manner preventing pull-out of said conductor means from said insulator.

12. The system as defined in claim 9, wherein said U-shaped support is flexible outwardly for permitting insertion of said insulator flanged portion into locking engagement with said openings.

13. A spark-type igniter assembly for igniting a combustible air fuel mixture comprising:

(a) shroud means including a generally U-shaped member with first surface portions thereof forming one electrode and with second surface portions thereof spaced from said first portions said second portions adapted for locking insulator attachment thereto and comprising an aperture formed in each leg thereof in oppositely disposed arrangement, said member having third portions adapted for connection to a support, whereupon said shroud and said one electrode are electrically grounded;

(b) insulator means received in said shroud means, said insulator means including a member having a hollow therein and having surface mounting portions formed thereon external with respect to said hollow, with said mounting portions comprising external flanges engaging said apertures in snap-locking arrngement for retaining said insulator in said shroud means; and (c) electrical lead means received in said hollow including a clip member having one end portion thereof including means defining a second electrode with other portions of said clip member engaging the inner periphery of said hollow in snap-locking engagement, said lead means including an electrical conductor having one end connected to said clip member and said second electrode and the other end extending from said insulator hollow for attachment thereto, wherein said first and second electrodes are spaced such that upon application of a predetermined electrical potential to said lead a spark is discharged between said first and second electrodes for ignition of said mixture.

14. A spark electrode assembly, said assembly comprising:

(a) a generally U-shaped support formed of an electrically conductive material and adapted for electrical connection to ground potential, said support including surface portions which, upon connection of said support to said ground potential, form one electrode for receiving a spark-discharge current flow, said support having an aperture formed in each opposite leg of said U-shape;

(b) insulator means including a hollow member having external flanged portions engageable with said support apertures for connecting said insulator means to said support member; and (c) electrical conductor means received in said hollow, said conductor means including:

(i) means defining a second electrode spaced a predetermined distance from said one electrode, (ii) means for retaining said lead in said insulator hollow, wherein, upon application of a sufficient electrical potential to said conductor means, a spark is discharged between said first and second electrode for ignition purposes.

15. An electrical spark ignition system, said system comprising:

(a) a generally U-shaped support member formed of an electrically conductive material and adapted for electrical connection to ground potential, said support member including surface portions thereof which, upon connection of said support member to said ground potential, form one electrode for receiving a spark-discharge current flow, said support member having an aperture formed in each opposite leg portion of said U-shape;

(b) insulator means including a hollow member having flanged portions engageable with said apertures for connecting said insulator means to said support member;

(c) electrical conductor means received in said hollow, wherein said legs of said U-shape are flexed outwardly for receiving said insulator means flanges, said conductor means including:

(i) means defining a second electrode spaced a predetermined distance from said one electrode, (ii) means for retaining said conductor means in said insulator hollow; and, (d) circuit means connected to said conductor means and connectable to a sufficient electrical potential such that upon application thereof a spark is discharged between said first and second electrodes for ignition purposes.

* * * * *